US005119950A

United States Patent [19]

Takemura

[11] Patent Number: 5,119,950

[45] Date of Patent: Jun. 9, 1992

[54] SUPPORT DEVICE FOR EXPANDABLE DOCUMENT FILE

[75] Inventor: Shun Takemura, Pacific Palisades, Calif.

[73] Assignee: Itoya of America, Ltd., Torrance, Calif.

[21] Appl. No.: 759,162

[22] Filed: Sep. 13, 1991

[51] Int. Cl.[5] ..... B65D 85/00

[52] U.S. Cl. ..... 206/425; 206/215; 220/530; 220/533

[58] Field of Search ..... 206/215, 425, 561; 220/500, 530, 532, 533, 551

[56] References Cited

U.S. PATENT DOCUMENTS

| | | | |
|---|---|---|---|
| 3,391,698 | 7/1968 | Wiles | 220/500 |
| 4,625,879 | 12/1986 | Liu | 220/533 |
| 4,730,727 | 3/1988 | Petroff | 206/425 |
| 4,742,931 | 5/1988 | Bennet | 220/532 |
| 4,971,201 | 11/1990 | Sathre | 220/533 |
| 5,064,068 | 11/1991 | Sheng | 206/425 |
| 5,064,069 | 11/1991 | Su | 206/425 |

*Primary Examiner*—David T. Fidei
*Attorney, Agent, or Firm*—Spencer, Frank & Schneider

[57] ABSTRACT

A support device for use with an expandable inherently collapsible document file. The document file comprises rigid end walls movable with respect to each other, pleated accordion-type side and bottom walls interposed between the end walls, and a plurality of spaced partitions arranged between the side walls in a direction parallel to the end walls. The partitions define a plurality of compartments for the storage of documents. The support device comprises a planar member having an inner surface, an outer frame positioned on the periphery of and extending from the inner surface of the planar member, and an inner frame extending from the inner surface of the planar member and spaced from the outer frame. The outer and inner frames define a channel therebetween for receiving grooved edges of an end wall of the expandible document file. The support device holds the expandable inherently collapsible document file in an expanded condition.

13 Claims, 3 Drawing Sheets

SUPPORT DEVICE FOR EXPANDABLE DOCUMENT FILE

BACKGROUND OF THE INVENTION

This invention relates to a support device for an expandable document file. In particular, it relates to a device for holding and supporting in an open position an inherently collapsible, expandable document file having a plurality of compartments so that documents can be inserted easily into the compartments.

Expandable document files having accordion-type side walls made of a resilient material and containing partitions for dividing the file into compartments or pockets are commercially available. These files, which are capable of being collapsed to a relatively small depth, are spread open when it is desired to place documents in the compartments. Because the side walls are resilient there is a tendency for the spread open or expanded file to return toward its collapsed condition. Consequently, the insertion of a document into the file can be awkward because one hand may be needed to hold the file open and the other to insert the document.

This problem has been recognized and devices for holding open expandable files are known. For example, U.S. Pat. No. 3,391,698 to Wiles discloses a holding device for a multi-compartment expandable file that is essentially a stiff piece of wire having two downwardly extending rigid legs. Each wire is disposed adjacent a side wall of the file with its legs inserted into the end compartments of the file, the length of the wire being substantially the same as the length to which the file is to be expanded. The wires hold the compartments open thereby enabling a user to more easily file an item in a desired compartment.

A drawback of the Wiles holding device is that only the upper half of the expandable file is positively held open because the downwardly extending legs extend only part way into the end compartments. Thus, the amount of reenforcement provided by the prior art holding device is limited. A further drawback of the Wiles holding device is the lack of a positive engagement between the stiff wire holding device and the expandable file. Since the downwardly extending legs are simply inserted into the end compartments of the expandable file, movement of the file relative to the holding device is possible.

SUMMARY OF THE INVENTION

It is an object of my invention to provide an improved support device for rigidly holding an expandable file in one of two different expanded conditions. The device has a simple construction, is inexpensive to manufacture, can be used easily by a person wishing to change the size of an expandable file, and supports a substantial portion of the side wall of the expanded file thereby improving its stability.

This object and others to become apparent as the specification progresses are accomplished by the present invention which comprises a support device for use with an expandable inherently collapsible document file. The document file comprises rigid end walls movable with respect to each other, pleated accordion-type side and bottom walls interposed between the end walls, and a plurality of spaced partitions arranged between the side walls in a direction parallel to the end walls.

The partitions define a plurality of compartments for the storage of documents.

The support device comprises a planar member having an inner surface, an outer frame positioned on the periphery of and extending from the inner surface of the planar member, and an inner frame extending from the inner surface of the planar member and spaced from the outer frame. The outer and inner frames define a channel therebetween for receiving grooved edges of an end wall of the expandible document file. The support device holds the expandable inherently collapsible document file in an expanded condition.

DESCRIPTION OF THE PREFERRED EMBODIMENT

Figure 1:
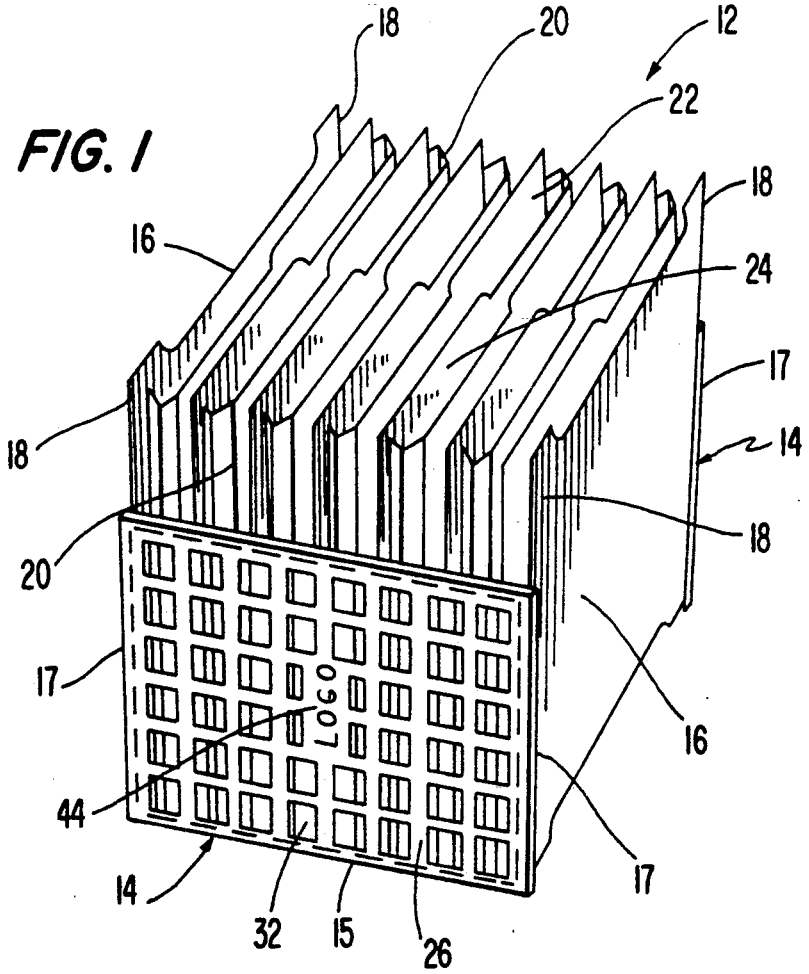
FIG. 1 is a perspective view of a preferred embodiment of the invention in which an expandable file is shown in a first expanded condition.
Figure 3:
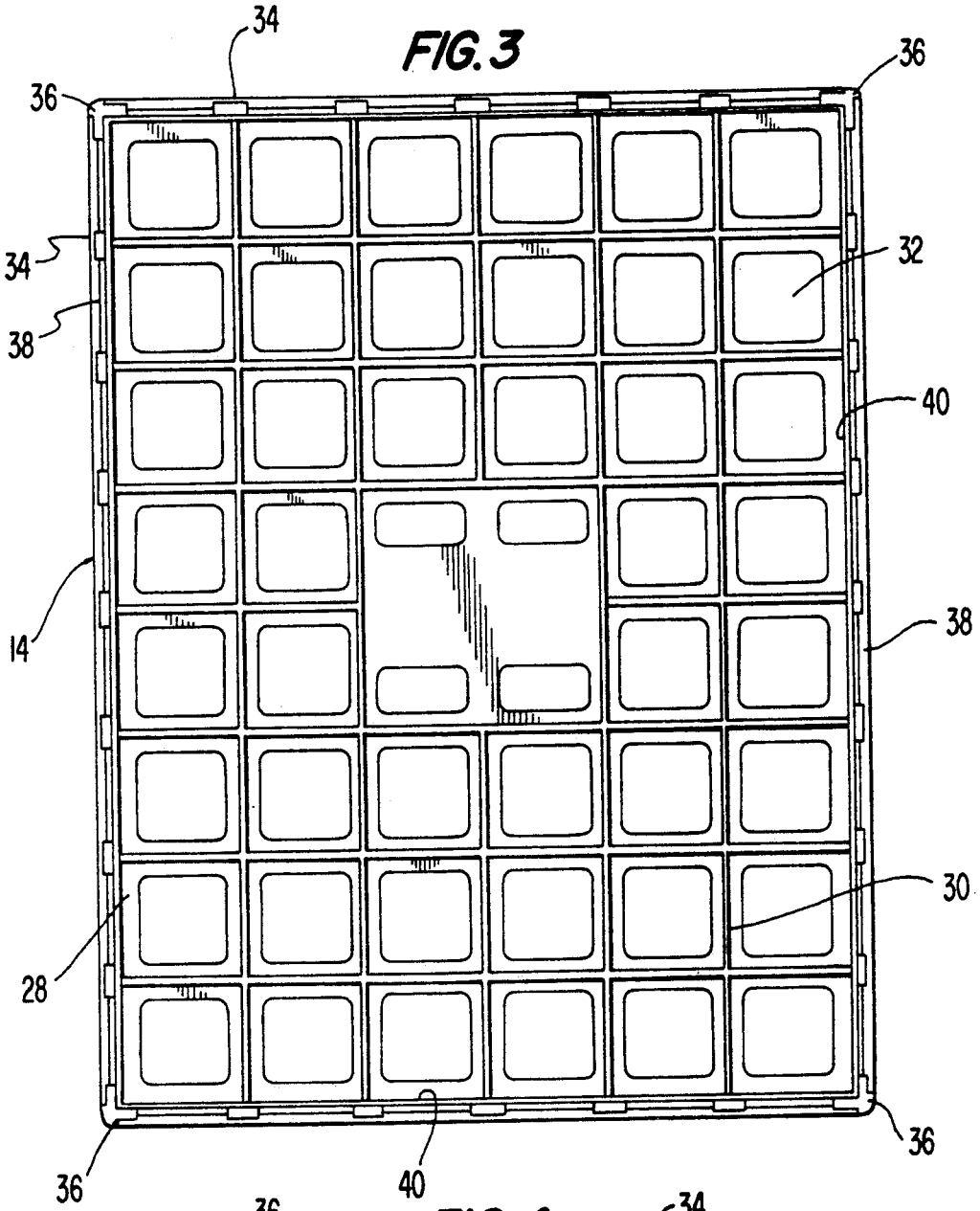
FIG. 3 is a plan view of a support device for holding the expandable file in the expanded conditions of FIGS. 1 and 2.
Figure 4:
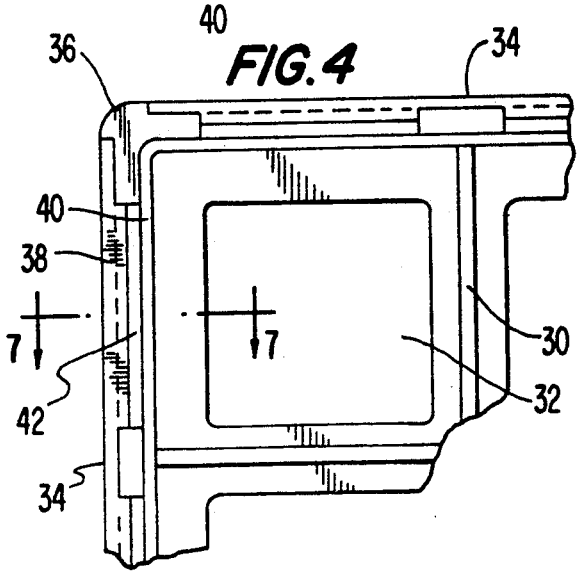
FIG. 4 is a partial sectional view of the support device of FIG. 3., shown on an enlarged scale.

FIG. 1 depicts an expandable document file 12 provided with rectangular support devices 14 (also called side support grids) for supporting the file in an expanded condition. The file 12, which is made of polypropelene, comprises rigid end walls 16 having grooved edges 18, pleated accordion-type side walls 20 and a pleated accordion-type bottom wall (not shown). Spaced partitions 22 are arranged between the side walls 20 in a direction parallel to the end walls 16 thereby defining a plurality of compartments 24 for the storage of documents.

Figure 2:
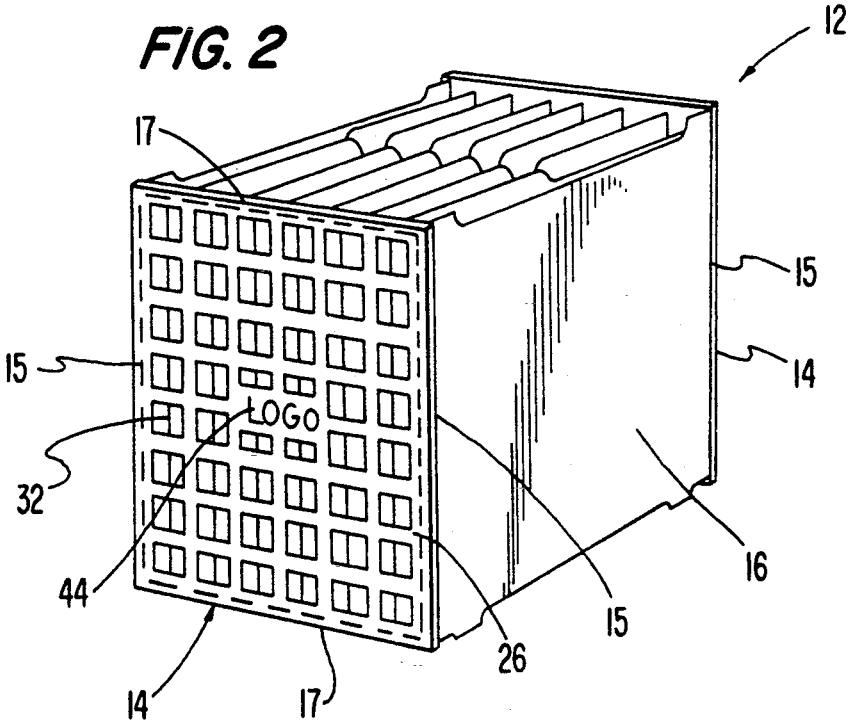
FIG. 2 is a perspective view of the preferred embodiment of the invention in which the expandable file is shown in a second expanded condition.

In FIG. 1, side support grids 14 are shown installed parallel to side walls 20 of the file 12 with their long sides 15 extending between the end walls 16 and their shorter sides 17 parallel to the end walls thereby providing a file of maximum size. In FIG. 2, the support grids 14 have been installed parallel to side walls 20 with their shorter sides 17 extending between the end walls 16 and their long sides 15 parallel to end walls 16. The latter arrangement provides a file which requires less shelf space when fewer documents are to be stored. The orientation of the side support grids 14 is also determined by the number of compartments 24 in the file 12 with which they are to be used.

Referring to FIGS. 1, 3, 4 and 7, each side support grid 14 comprises a rectangular planar member having apertures 32, an outer surface 26 and an inner surface 28. The inner surface 28 is provided with reinforcing ridges 30 to increase its rigidity, and the apertures 32 are provided to decrease the weight of the support grid and make it easier to grasp during installation on the document file 12.

An outer frame 34 surrounds the periphery of the planar member of the side support grid !4 and is perpendicular to and extends from the inner surface 28. Frame 34 has openings 36 at the corners thereof, and a plurality of spaced retention elements 38 project from the outer frame 34 in a direction parallel to the inner surface 28 of the planar member. A continuous inner frame 40, which is perpendicular to the inner surface 28, is spaced from and parallel to the outer frame 34. The outer frame 34, inner frame 40 and retention elements 38 define a channel 42 which extends around the periphery of the planar member. In a preferred embodiment of the invention the planar member, outer and inner frames and the retention elements of the side support grids 14 are fabricated from a single piece of polypropylene having nominal overall dimensions of 7×180×237 mm.

Prior to assembly of the rectangular side support grids 14 to the file 12, the user would first determine whether the grids should be placed with their long sides parallel or perpendicular to the end walls 16 of the file. For example, if the file 12 is of a type having twelve compartments, the support grids 14 would be installed with their long sides parallel to the end walls 16 and their shorter sides perpendicular to the walls 16. On the other hand, if the file is of a type having twenty or thirty-one compartments, the side support grids can be installed with either orientation depending on the number of documents to be filed and the space available for the file.

Figure 5:
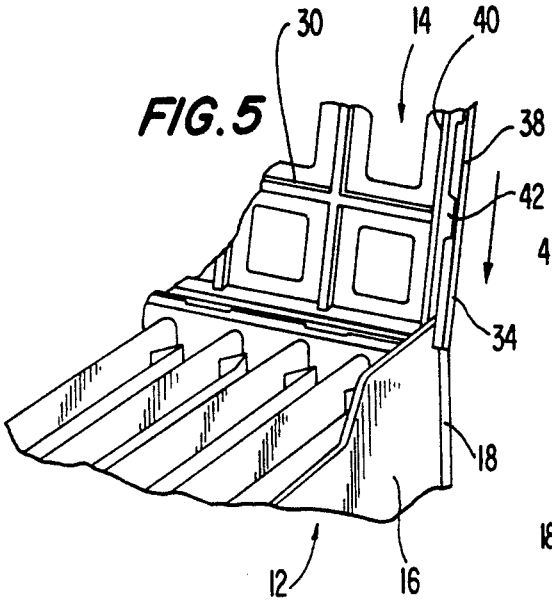
FIG. 5 is a perspective view of the manner in which the support device of FIG. 3 is engaged with an expandable file.
Figure 6:
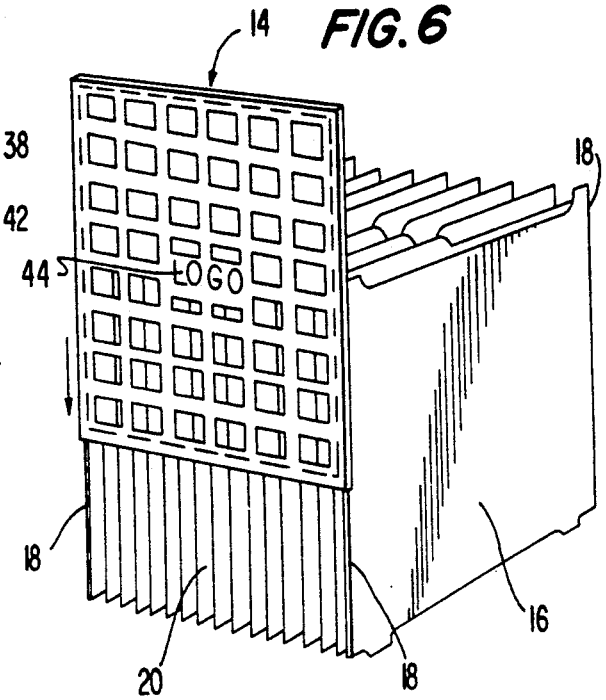
FIG. 6 is a perspective view of the manner in which the support device of FIG. 3 is attached to the expandable file after the support device and file have been engaged as shown in FIG. 5.
Figure 7:
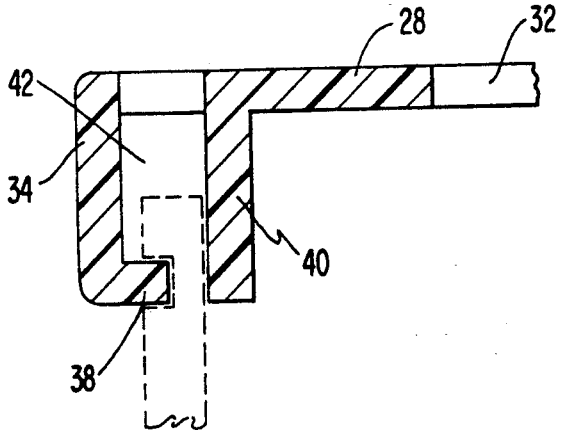
FIG. 7 is a partial sectional view of the support device of FIG. 4, taken along line VII—VII, on an enlarged scale.

Referring to FIGS. 5 and 6, the file 12 is placed on a flat surface such as a desk top. A side support grid 14 is installed, with the logo 44 on the outer surface 26 of the grid facing outward, by inserting about one-inch of one of the grooved edges 18 of an end wall 16 through an opening 36 in the outer frame 34. The other grooved edge 18 on the opposite side of the sam end wall !6 is then inserted through a corresponding opening 36 in the outer frame. Next, the opposite edges 18 of the end wall 16 are slid into opposite portions of the channel 42 formed by the outer frame 34, the inner frame 40 and the retention elements 38. The side support grid 14 is pushed downward until its outer frame 34 contacts the top of the desk.

In the same way, the grooved edges 18 of the other end wall 16 are inserted into the channel 42 of the other side support member 14, and the support grid pushed downward until the outer frame is flush with the desktop. The dimensions of outer frame 34, inner frame 40 and retention elements 38 defining channel 42 are selected so that the side support grids 14 securely engage the edges 18 of the file 12 while allowing the grids to be easily removed from the file.

It will be understood that the above description of the present invention is susceptible to various modifications, changes and adaptations, and the same are intended to be comprehended within the meaning and range of equivalents of the appended claims.

What is claimed is:

1. In combination with an expandable inherently collapsible document file comprising rigid end walls movable with respect to each other and having grooved edges, pleated accordion-type side and bottom walls interposed between said end walls, and a plurality of spaced partitions arranged between said side walls in a direction parallel to said end walls, said partitions defining a plurality of compartments for the storage of documents, a support device comprising a planar member having an inner surface;

an outer frame positioned on the periphery of said planar member, said outer frame extending from the inner surface of said planar member; and an inner frame extending from the inner surface of said planar member and spaced from said outer frame, said outer and inner frames defining a channel therebetween for receiving the grooved edges of an end wall of said expandible document file, whereby said support device holds said expandable inherently collapsible document file in an expanded condition.

2. Apparatus for storing documents comprising:

an expandable inherently collapsible document file including rigid end walls movable with respect to each other and having grooved edges;

pleated accordion-type side and bottom walls interposed between said end walls; and a plurality of spaced partitions arranged between said side walls in a direction parallel to said end walls, said partitions defining a plurality of compartments for the storage of documents; and a support device including a planar member having an inner surface;

an outer frame positioned on the periphery of said planar member, said outer frame extending from the inner surface of said planar member; and an inner frame extending from the inner surface of said planar member and spaced from said outer frame, said outer and inner frames defining a channel therebetween for receiving the grooved edges of an end wall of said expandible document file, whereby said support device holds said expandable inherently collapsible document file in an expanded condition.

3. Apparatus for storing documents as defined in claim 2 wherein said outer frame is provided with a retention element projecting from said outer frame in a direction parallel to the inner surface of said planar member, said retention element cooperating with said outer and inner frames to further define said channel.

4. Apparatus for storing documents as defined in claim 2 wherein a plurality of spaced retention elements are provided, said retention elements being spaced along said channel.

5. Apparatus for storing documents as defined in claim 2 wherein said planar member is rectangular, said rectangular planar member having a long side and a shorter side.

6. Apparatus for storing documents as defined in claim 5 wherein said outer frame has at least two openings at the portions thereof where said long and shorter sides of said planar member intersect, said openings being provided for insertion of the grooved edges of the end wall of said document file.

7. Apparatus for storing documents as defined in claim 2 wherein the inner surface of said planar member is provided with reenforcing ridges, said reenforcing ridges rigidifying said planar member.

8. Apparatus for storing documents as defined in claim 7 wherein said planar member is provided with a plurality of apertures in the surface thereof, said ridges being interposed between said apertures.

9. Apparatus for storing documents as defined in claim 2 wherein said support device is made of polypropylene.

10. Apparatus for storing documents comprising:

an expandable inherently collapsible document file including rigid end walls movable with respect to each other and having grooved edges;

pleated accordion-type side and bottom walls interposed between said end walls; and a plurality of spaced partitions arranged between said side walls in a direction parallel to said end walls, said partitions defining a plurality of compartments for the storage of documents; and a support device including a rectangular planar member having an inner surface, said rectangular planar member having a long side and a shorter side;

an outer frame positioned on the periphery of said planar member, and extending from the inner surface of said planar member, said outer frame having at least two openings at the portions thereof where said long and shorter sides of said planar member intersect, said openings being provided for insertion of the grooved edges of the end wall of said document file;

a plurality of spaced retention elements projecting from said outer frame in a direction substantially parallel to the inner surface of said planar member, said plurality of spaced retention elements cooperating with said outer and inner frames to further define said channel; and an inner frame extending from the inner surface of said planar member and spaced from said outer frame, said outer and inner frames defining a channel therebetween for receiving the grooved edges of an end wall of said expandible document file, whereby said support device holds said expandable inherently collapsible document file in an expanded condition.

11. Apparatus for storing documents as defined in claim 10 wherein the inner surface of said planar member is provided with reenforcing ridges, said reenforcing ridges rigidifying said planar member.

12. Apparatus for storing documents as defined in claim 11 wherein said planar member is provided with a plurality of apertures in the surface thereof said ridges being interposed between said apertures.

13. Apparatus for storing documents as defined in claim 10 wherein said support device is made of polypropylene.

* * * * *